US008082687B2

(12) United States Patent
Cohen

(10) Patent No.: US 8,082,687 B2
(45) Date of Patent: Dec. 27, 2011

(54) TOWEL TWIRLING MECHANISM

(76) Inventor: Michael Cohen, Chicago, IL (US)

( * ) Notice: Subject to any disclaimer, the term of this patent is extended or adjusted under 35 U.S.C. 154(b) by 0 days.

(21) Appl. No.: 12/691,382

(22) Filed: Jan. 21, 2010

(65) Prior Publication Data

US 2011/0173851 A1 Jul. 21, 2011

(51) Int. Cl.

| | |
|---|---|
| ***G09F 17/00*** | (2006.01) |
| ***G09F 3/00*** | (2006.01) |
| ***G09F 7/00*** | (2006.01) |
| ***G09F 23/00*** | (2006.01) |
| ***G09F 21/02*** | (2006.01) |
| ***A41D 27/08*** | (2006.01) |
| ***A41D 27/20*** | (2006.01) |
| ***A41D 27/00*** | (2006.01) |
| ***A41D 27/06*** | (2006.01) |
| ***A63H 1/06*** | (2006.01) |

(52) U.S. Cl. ..... 40/218; 40/311; 40/611.04; 40/636; 40/329; 40/586; 2/246; 2/249; 2/250; 2/2.12; 2/245; 446/236; 446/397; 446/240; 446/250; 446/256; 446/259; 116/173; 116/174

(58) Field of Classification Search ..... 40/218, 40/311, 611.04, 636, 329, 586; 2/246, 249, 2/250, 2.12, 245; 446/236, 397, 240, 250, 446/256, 259; 116/173, 174

See application file for complete search history.

(56) References Cited

U.S. PATENT DOCUMENTS

| | | | | |
|---|---|---|---|---|
| 934,724 | A | 9/1909 | Gravier | |
| 1,416,653 | A * | 5/1922 | Lenneberg | 2/160 |
| 3,037,322 | A * | 6/1962 | Baumgartner, Jr. | 446/242 |
| D339,496 | S | 9/1993 | Corcoran | |
| D409,874 | S | 5/1999 | Amick et al. | |
| 6,256,840 | B1 | 7/2001 | Elliott | |
| 6,849,055 | B1 | 2/2005 | Williams | |
| 7,160,598 | B2 | 1/2007 | Sabo | |
| D547,588 | S | 7/2007 | Almeter | |
| 2005/0098084 | A1 * | 5/2005 | Puett, III | 116/173 |
| 2007/0094826 | A1 | 5/2007 | Chandler et al. | |
| 2008/0263801 | A1 | 10/2008 | Morris | |
| 2009/0151105 | A1 | 6/2009 | Bohannon et al. | |
| 2009/0236299 | A1 | 9/2009 | Hall | |
| 2011/0028065 | A1 * | 2/2011 | Arcovio | 446/242 |

* cited by examiner

*Primary Examiner* — Joanne Silbermann
*Assistant Examiner* — Syed A Islam
(74) *Attorney, Agent, or Firm* — Adam Sacharoff

(57) ABSTRACT

An article, such as a towel, having an opening to secure a twirling mechanism thereto. The twirling mechanism having a handle extending from a bottom portion thereof and having a mechanism to permit rotating of the handle with respect to the fabric-article, such that the fabric article is capable of twirling around the twirling mechanism. The twirling mechanism may in other embodiments include noise maker when the handle is rotated.

4 Claims, 4 Drawing Sheets

TOWEL TWIRLING MECHANISM

BACKGROUND OF THE INVENTION

The background of the invention relates to a mechanism to aid in twirling a towel. In some sporting events it is very common for fans to have small hand-held towels with the home team's logo or colors. During the game, the fans hold onto one corner of the towel and rotate their hands, causing the towel to twist and twirl. However, this causes the towel to twist and curl onto itself, not permitting the colors of the sport team to be readily shown or seen. There is thus a need to provide for a mechanism that permits the twirling of the towel with relative ease and in some instances without curling or twisting.

SUMMARY OF THE INVENTION

One or more of the embodiments provided in the present invention relates to a fabric-article having a twirling mechanism secured thereto. The twirling mechanism includes a handle extending from a bottom portion thereof and has a means to permit rotating of the handle with respect to the fabric-article. Therefore, the fabric article is capable of twirling around the twirling mechanism.

In one embodiment, the twirling mechanism further includes bottom and top grommet sections attached to each other through an opening in the fabric-article. A handle cap is positioned on a side of the fabric-article opposite the handle and has members extending through the opening in the fabric-article for securing to an end of the handle. The handle cap is further positioned between the top and bottom grommet sections to permit rotation thereof with respect to the grommet sections thereby allowing twirling of the fabric-article by rotation of the handle. In another embodiment, the top grommet section may include an indentation along a top portion thereof sized to receive a disc. The disc which may be removable could include printed matter to provide team spirit or advertising material. In yet another embodiment, the bottom grommet section may include a radial groove along a bottom portion thereof. The radial groove would be sized to accommodate a portion of the handle for packaging and/or storage purposes.

In another embodiment thereof, the fabric-article would include a twirling mechanism secured through an opening in the fabric article. The twirling mechanism would have a handle extending from a bottom portion thereof and have a means to permit rotating of the handle with respect to the fabric-article, such that the fabric article is capable of twirling around the twirling mechanism. In addition, the twirling mechanism would further include a means for making noise when the handle is rotated.

The twirling mechanism, in this embodiment, would include a bottom eyelet and a top fastener positioned on opposite sides of the opening in the fabric article. A bottom cap would be positioned below the bottom eyelet and have a bottom section secured to an end of the handle. The bottom cap would further have a top section extending therefrom to secure to a lower extension of the top fastener. The top fastener is secured to the bottom cap such that the top fastener and the bottom cap are capable of rotating with respect to the bottom eyelet and fabric article.

The means for making noise may include an annular ring positioned below the top fastener and positioned on the opposite side of the fabric article to the bottom eyelet. The annular ring is secured to the bottom eyelet such that the annular ring and bottom eyelet are non-rotating members. The annular ring may include an opening for the lower extension of the top fastener and may include an internally facing rack. The means for making noise further includes a clicker having a lower portion secured to a top section of the top fastener and having an arm extending therefrom. The arm is positioned against a portion of the rack such that when the top fastener rotates with the rotation of the handle, the clicker rotates clicking the arm against the rack.

In other embodiments, a top cap may be used to secure to the annular ring. The top cap may need apertures and/or slots to permit a sound from the means from making noise to emanate therethrough.

Numerous other advantages and features of the invention will become readily apparent from the following detailed description of the invention and the embodiments thereof, from the claims, and from the accompanying drawings.

DESCRIPTION OF THE DRAWINGS

A fuller understanding of the foregoing may be had by reference to the accompanying drawings, wherein.

DETAILED DESCRIPTION OF THE EMBODIMENTS

Figure 1A:
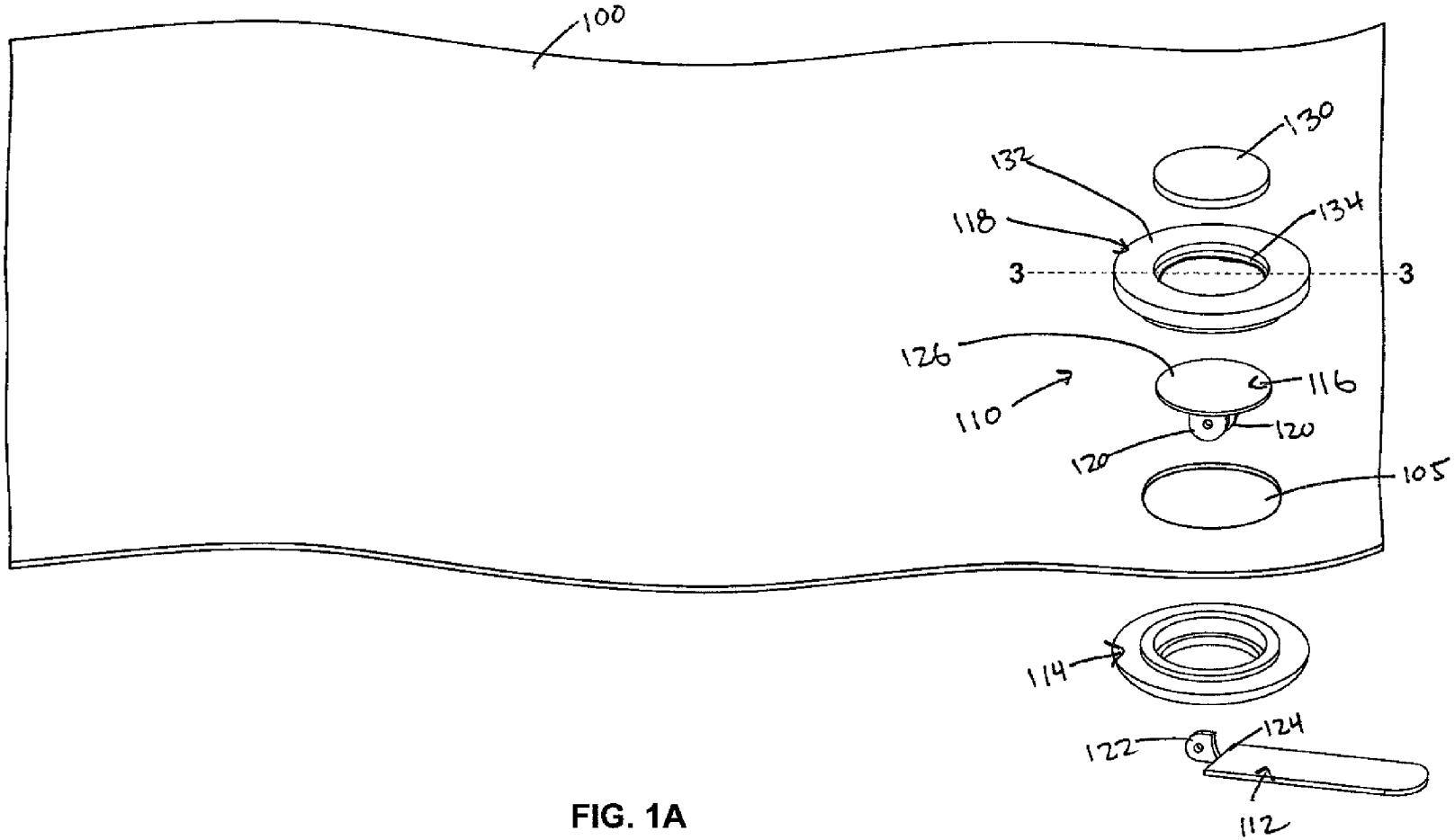
FIG. 1*a* is an exploded view of a fabric-article with a twirling mechanism in accordance with a first embodiment of the invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring now to FIGS. 1*a* through 3, there is shown generally a towel or other similar article, such as but not limited to a cloth, nylon material, generally referred to as a fabric-article 100. The article 100 includes an opening or bore 105 there through in which a twirling mechanism 110 can be secured thereto. The twirling mechanism 110 permits a user to hold on to the fabric-article 100 and by twisting their wrist or arm, twirl the article 100 in circles.

The twirling mechanism 110 includes a handle 112, a bottom grommet section 114, a handle cap 116, and a top grommet section 118. The bottom and top grommet sections 114 and 118 are attached to each other, preferably press fitted together, on either side of the opening 105 of the fabric-article 100. The handle cap 116 includes members 120 extending below to secure to an end extension 122 emanating from an end 124 of the handle 112. The handle cap 116 has a top portion 126 that would be captured by the bottom grommet section when assembled (illustrated in FIG. 2) but would still allow free rotation of the handle cap and handle together.

The twirling mechanism 110 may further include a disc 130 that may be removably from a top portion 132 of the top grommet section 118. The disc 130 may provide for a commemorative disc displaying a team symbol or color, or an advertisement disc or other type disc device. The top portion 132 of the top grommet section 118 would include an indentation 134 to accommodate and secure the disc 130 in place (illustrated in FIG. 3). In other embodiments, the top portion 132 of the top grommet section 118 may be solid, not providing from the disc 130.

Figure 1B:
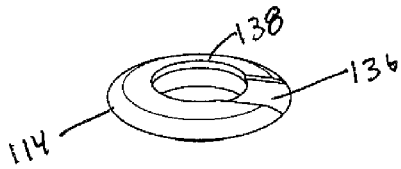
FIG. 1*b* is a bottom view of a bottom grommet section illustrating a radial groove to accommodate a portion of the handle.
Figure 2:
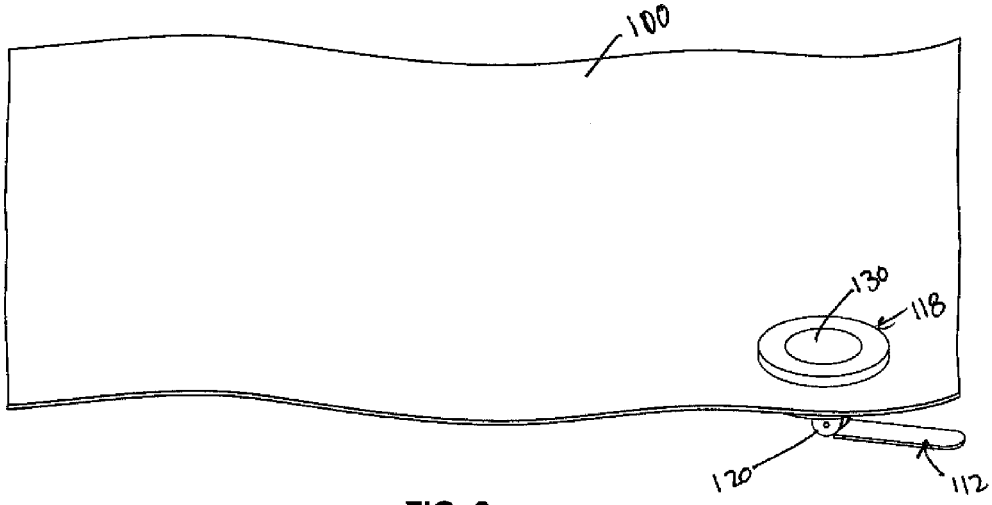
FIG. 2 is a perspective view of the fabric article with twirling mechanism from FIG. 1*a* illustrated in an assembled configuration.
Figure 3:
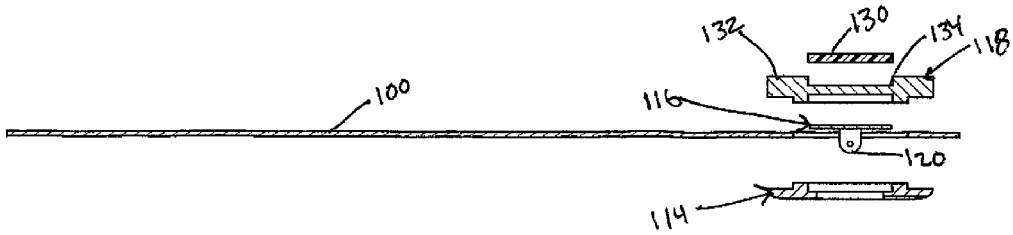
FIG. 3 is a partial section view of the fabric article with twirling mechanism taken along line 3-3 from FIG. 1*a;*

In another feature of the twirling mechanism 110, the bottom grommet section 114 may include a radial groove 136 along a bottom portion 138 thereof (illustrated in FIG. 1B). The radial groove 136 may be used to seat the handle for storage and/or packaging purposes.

Figure 4:
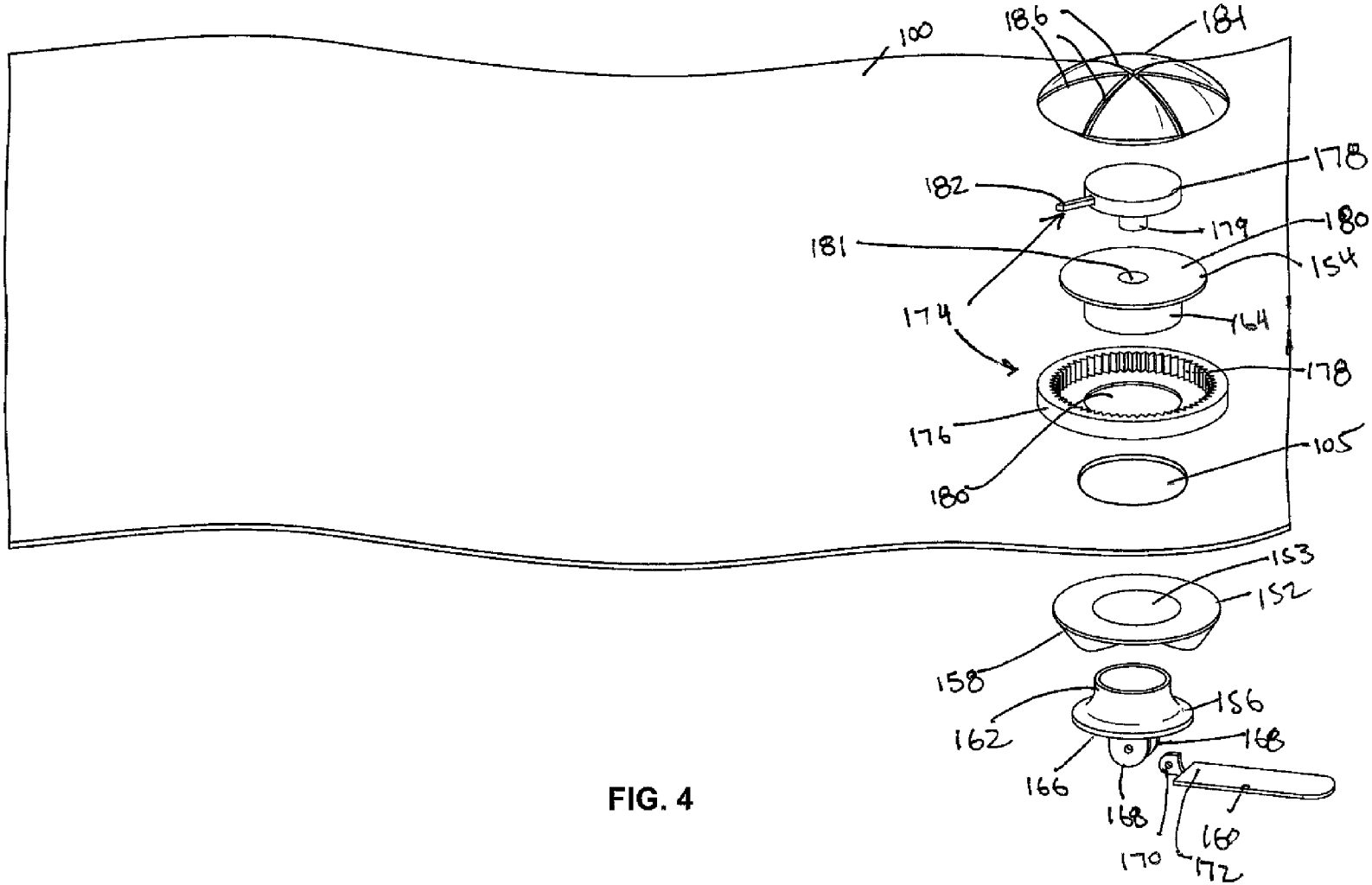
FIG. 4 is an exploded view of a fabric-article with a twirling mechanism and noise making mechanism in accordance with a second embodiment of the invention.
Figure 5:
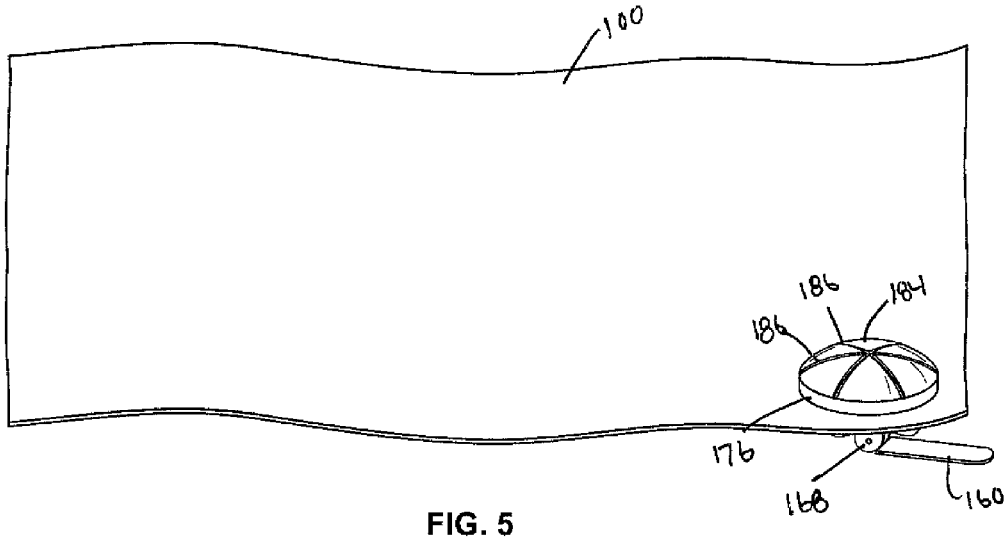
FIG. 5 is a perspective view of the FIG. 4 illustrated in an assembled configuration.
Figure 6:
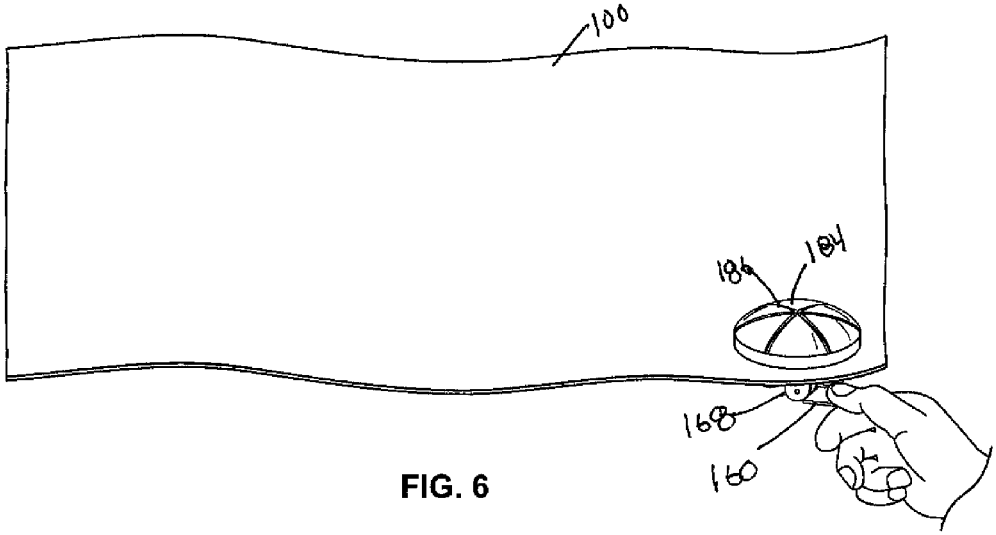
FIG. 6 is a perspective view of FIG. 5 illustrating a hand of a user gripping the handle.

Turning now to FIGS. 4 through 6, a second embodiment of a twirling mechanism 150 is illustrated for use in connection with a fabric-article 100. The second type twirling mechanism 150 provides for a means for making noise, similar to a clicking or noise-type maker.

The second type twirling mechanism 150 includes a bottom eyelet 152 and a top fastener 154 positioned on either side of the opening 105 of the fabric-article 100. In this embodiment, a bottom cap 156 positioned on the lower side section 158 of the bottom eyelet 152 is used to secure the handle 160 to the fabric-article 100. This is accomplished by having a top section 162 of the bottom cap 156 extend through an opening 153 defined by the bottom eyelet 152 and attaching to a lower extension 164 of the top fastener 154, while a bottom section 166 of the bottom cap 156 includes a pair of flanges 168 that secure to a member 170 extending from an end 172 of the handle 160. Alternatively, the lower extension 164 of the top fastener 154 may extend through the opening 153 in the bottom eyelet 152 and attach to the top section 162 of the bottom cap 156. In either case, it is important to note that the top fastener 154 and the bottom cap 156 are freely able to rotate with respect to the bottom eyelet 152.

The means for making noise 174 includes an annular ring 176 with an internally facing rack 178. The annular ring 176 is positioned against the opening 105 of the fabric-article 100 below the top fastener 154 and secured to the bottom eyelet 152 such that the bottom eyelet 152 and the annular ring 176 do not rotate or move. An opening 180 in the annular ring 176 permits for the lower extension 164 of the top fastener to extend there through. The annular ring 176 works in concert with a clicker 178. The clicker 178 includes a lower member 179 that is secured to an aperture 181 in the top portion 180 of the top fastener 154 and includes an extending arm 182 that is positioned against the rack 178. Therefore, when the top fastener 154 rotates with the handle, the clicker 178 rotates causing the arm 182 to click or pop against the rack 178 making a clicking noise, similar to a noise maker.

In other aspects of this embodiment, a top cap 184 may be provided to secure over the annular ring 176 enclosing the clicker 178. However, the top cap 184 may be required to have slots 186, openings, or holes, to help permit the sounds from resonating through and emanating from the noise means. The size of the slots 186 may be different from the illustrating if it is deemed necessary to have larger openings to permit the sound to be adequately released and not muffled.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

I claim:

1. An article comprising:

a fabric-article having an opening defined therethrough; and a twirling mechanism secured through the opening, the twirling mechanism having a handle extending from a bottom portion thereof and having a means to permit rotating of the handle with respect to the fabric-article, such that the fabric article is capable of twirling around the twirling mechanism, and wherein twirling mechanism further includes:

a bottom grommet section attached to a top grommet section, wherein the bottom and top grommet sections are positioned on either side of the opening in the fabric-article, and a handle cap positioned on a side of the fabric-article opposite the handle and having members extending through the opening in the fabric-article for securing to an end of the handle, and wherein the handle cap being positioned between the top and bottom grommet sections is positioned to permit rotation thereof with respect to the top and bottom grommet sections thereby allowing twirling of the fabric-article by rotation of the handle, and wherein the bottom grommet section includes a radial groove along a bottom portion thereof, the radial groove sized to accommodate a portion of the handle.

2. An article comprising:

a fabric-article having an opening defined therethrough; and a twirling mechanism secured through the opening, the twirling mechanism having a handle extending from a bottom portion thereof and having a means to permit rotating of the handle with respect to the fabric-article, such that the fabric article is capable of twirling around the twirling mechanism, wherein the twirling mechanism further includes:

a bottom grommet section attached to a top grommet section, wherein the bottom and top grommet sections are positioned on either side of the opening in the fabric-article; and a handle cap positioned on a side of the fabric-article opposite the handle and having members extending through the opening in the fabric-article for securing to an end of the handle, and wherein the handle cap being positioned between the top and bottom grommet sections is positioned to permit rotation thereof with respect to the top and bottom grommet sections thereby allowing twirling of the fabric-article by rotation of the handle.

3. The article of claim 2, wherein the top grommet section includes an indentation along a top portion thereof, the indentation sized to receive a removable disc, and wherein the removable disc has printed material thereon.

4. The article of claim 2, wherein the bottom grommet section includes a radial groove along a bottom portion thereof, the radial groove sized to accommodate a portion of the handle.

* * * * *